United States Patent [19]

Blanchard et al.

[11] 4,207,068

[45] Jun. 10, 1980

[54] PROCESS FOR PRODUCING CHAMBRAY AND OTHER DYED FABRICS THROUGH PHOSPHORYLATION

[75] Inventors: Eugene J. Blanchard, New Orleans; Joseph S. Bruno, Chalmette; Gloria A. Gautreaux, Metairie, all of La.

[73] Assignee: The United States of America as represented by the Secretary of Agriculture, Washington, D.C.

[21] Appl. No.: 951,539

[22] Filed: Oct. 16, 1978

[51] Int. Cl.[2] ..... D06M 1/18; D06P 3/60

[52] U.S. Cl. ..... 8/493; 8/116 P; 8/495; 8/584

[58] Field of Search ..... 8/17, 116 P

[56] References Cited

U.S. PATENT DOCUMENTS

| | | | |
|---|---|---|---|
| 2,037,370 | 4/1936 | Epselen et al. | 8/116 P X |
| 2,524,783 | 10/1950 | Ford et al. | 8/116 P X |
| 3,488,140 | 1/1970 | Gallagher | 8/116 |

OTHER PUBLICATIONS

R. Rabinowitz, "Warp Dyeing of Yarns for Denim and Chambrays", Textile Chemist and Colorist, vol. 8 (1976) p. 44.

*Primary Examiner*—Sandra M. Person
*Attorney, Agent, or Firm*—M. Howard Silverstein; David G. McConnell; Raymond C. Von Bodungen

[57] ABSTRACT

A process is disclosed for producing dyed fabrics by treating cotton with inorganic phosphorylating agent, curing, and then dyeing to develop the pattern.

10 Claims, No Drawings

PROCESS FOR PRODUCING CHAMBRAY AND OTHER DYED FABRICS THROUGH PHOSPHORYLATION

BACKGROUND OF INVENTION

1. Field to which Invention Relates

This invention relates to a process for producing chambray and other dyed fabrics.

2. Description of the Prior Art

Chambray is a cotton fabric that contains a colored warp and an undyed filling. The yarns are usually dyed on the warp beam, sized, and then woven with a white filling to obtain the desired effect. In this process the yarns are untreated except for the sizing operation, which is employed to protect the yarns during weaving. The Padazoic process, reported in Textile Chemist and Colorist, Vol. 8, 1976, p. 44, combines the dyeing and sizing operation in a single step operation.

Gallagher, U.S. Pat. No. 3,488,140, Jan. 6, 1970, has demonstrated that cotton can be crosslinked by a pad-cure procedure with alkali-metal phosphates or condensed phosphate salts. No mention of dye-resistant properties of phosphorylated cotton is made.

In all prior work, no process has been described in which cellulosic yarns have been treated with inorganic phosphorylating agent, woven into fabric, cured, and then dyed with a suitable dye for cotton to produce chambray fabric. Also, no method has been described to produce frosted and shade differential fabrics by selectively treating the fabric with phosphorylating agent, curing, and then dyeing with cotton dyes to produce the desired effect.

SUMMARY OF THE INVENTION

The instant invention is a process for producing dyed fabrics with color and shade differential by piece dyeing phosphorylated fabric. The process comprises the following steps: (1) treating cellulose with a formulation of about 5% to 30%, by weight, of an inorganic phosphorylating agent and about 0% to 30%, by weight, of urea; (2) curing the cellulose for about 2.5–10 minutes at about 160°–170° C.; (3) dyeing the cellulose with a cotton dye at a concentration of about 0.1% to 10% based on the weight of the fabric.

It is the primary object of this invention to produce dyed fabrics with color or shade differential.

It is another object of this invention to produce chambray fabric by piece dyeing the treated fabric with cotton dyes.

It is a further object to provide a method to produce frosted fabric and fabric with shade differential between the front and back side by a simple pretreatment with phosphorylating agent and subsequent dyeing operation.

DESCRIPTION OF THE PREFERRED EMBODIMENTS

We have found that phosphorylating cotton with inorganic phosphorylating agents is effective for producing cellulosic fabric with dye resistance. This is particularly noteworthy because it allows a chambray, frosted, or shade-differential fabric to be produced by piece dyeing. This greatly facilitates inventory control because different colored chambray fabrics can be produced from the same base fabric instead of having to store a large quantity of dyed yarns.

The pretreatment system for producing chambray is composed of inorganic phosphorylating agent selected from a group consisting of dibasic ammonium phosphate ($[NH_4]_2HPO_4$), monobasic ammonium phosphate ($NH_4H_2PO_4$), dibasic potassium phosphate ($K_2HPO_4$), dibasic sodium phosphate ($Na_2HPO_4$), monobasic sodium phosphate ($NaH_2PO_4$), and sodium hexametaphosphate $(NaPO_3)_6$. These may be used from about 15 g to 30 g for each 100 g of solution or from 15% to 30% by weight of the treatment formulation. Urea is also used in the pretreatment system in combination with dibasic and monobasic phosphorylating agents at a 2:1 weight ratio of urea to phosphorylating agent. A 1:1 ratio can also be used but it is not as effective as the 2:1 ratio. The urea is needed to phosphorylate cellulose with dibasic phosphates, but cellulose can be phosphorylated with monobasic phosphates without urea. However, urea is also used in these cases to prevent a large reduction in the strength of the treated fabric. After the yarns are impregnated with phosphorylating agent, they are dried for 15 minutes to 30 minutes at 60° C. to 100° C. Other suitable combinations of time and temperature can be used. The yarns are then woven into a filling oxford or suitably constructed fabric. The phosphorylated yarns were used for the filling. The filling was then cured for 2.5 to 10 minutes at 160° to 170° C. The chambray effect was obtained by dyeing with a suitable cotton dye at a concentration of about 0.5% to 4% based on the weight of the fabric.

The same group of phosphorylating agents that are used to treat cotton yarns to produce chambray can be used to produce frosted and shade differential fabrics. Cotton terry toweling is treated only on the pile with about 15% to 30% by weight of phosphorylating agent with urea as previously indicated except in the case of $(NaPO_3)_6$. The frosted effect is developed by dyeing the fabric with any suitable cotton dye at a concentration of from about 0.1% to 1% based on the weight of the fabric. Only the backside and ground of the fabric are dyed. The phosphorylated pile remains undyed or frosted.

The same group of phosphorylating agents that are used to produce frosted fabrics can be used to produce fabrics with shade differential. Cotton terry toweling or other cellulose-containing fabric is treated only on one side of the fabric with about 5% to 15% by weight of phosphorylating agent. The fabric is dried and cured as previously indicated.

The shade differential effect is produced by dyeing the fabric with any suitable cotton dye at a concentration of from about 0.5% to 10% based on the weight of the fabric. Almost any shade differential effect can be obtained by varying the degree of phosphorylation and dye concentration.

In general the process for producing dyed fabrics with color and shade differential by piece dyeing phosphorylated fabric consists of the following steps: (1) treating cellulose with a formulation of about 5% to 30%, by weight, of an inorganic phosphorylating agent and about 0% to 30%, by weight of urea; (2) curing the cellulose for about 2.5–10 minutes at about 160°–170° C.; (3) dyeing the cellulose with a cotton dye at a concentration of about 0.1% to 10% based on the weight of the fabric.

In order to produce a chambray fabric one would use a yarn of cellulose, dried for about 15 minutes to 30 minutes at about 60° C. to 100° C. after treating with phosphorylating agent and then weave with a starch sized warp to produce a fabric with a balanced weave. Upon dyeing, a chambray is produced which has a dyed warp and an undyed filling.

In order to produce a frosted fabric, a cotton pile fabric is dyed.

For the above processes inorganic phosphorylating agents can be selected from the following:

(1) dibasic ammonium phosphate [$(NH_4)_2HPO_4$].
(2) monobasic ammonium phosphate [$NH_4H_2PO_4$].
(3) dibasic potassium phosphate [$K_2HPO_4$].
(4) dibasic sodium phosphate [$Na_2HPO_4$].
(5) monobasic sodium phosphate [$NaH_2PO_4$].
(6) sodium hexametaphosphate $(NaPO_3)_6$.

The following examples further describe the invention. They are given as illustration and should not be considered as limiting the scope of the invention.

EXAMPLE 1

Scoured and bleached 18/1 filling yarns in skein form were treated with a solution containing 15 g $(NH_4)_2HPO_4$ and 30 g urea per 100 g of solution. The yarns were dried for 15 minutes at 100° C. These yarns were then woven with 30/1 warp yarns that were starch sized to produce a filling oxford weighing 5 oz/yd$^2$. The fabric was cured for 2.5 minutes at 170° C. After curing, the fabric was dyed with 4% Reactive Blue 1 based on the weight of the fabric. The resulting fabric had a chambray appearance. The warp yarns were dyed blue while the phosphorylated filling yarns were undyed.

EXAMPLE 2

The scoured and bleached 18/1 filling yarns were treated with phosphorylating agent and dyed to produce a chambray as in Example 1 except that the phosphorylating agent was $NH_4H_2PO_4$.

EXAMPLE 3

Scoured and bleached 18/1 filling yarns in skein form were treated with a solution containing 15 g $K_2HPO_4$, 30 g urea, and 55 g water. The yarns were dried for 30 minutes at 70° C.These yarns were then woven into a filling oxford as in Example 1. The fabric was cured for 9 minutes at 170° C. After curing and rinsing with water, the fabric was dyed with 0.5% Reactive Blue 1 based on the weight of the fabric. The resulting fabric had a chambray appearance. The warp yarns were dyed light blue while the phosphorylated filling yarns were undyed.

EXAMPLE 4

The scoured and bleached 18/1 filling yarns were treated with phosphorylating agent and dyed to produce a chambray as in Example 3 except the phosphorylating agent was $Na_2HPO_4$.

EXAMPLE 5

The scoured and bleached 18/1 filling yarns were treated with phosphorylating agent and dyed to produce a chambray as in Example 3 except the phosphorylating agent was $NaH_2PO_4$.

EXAMPLE 6

Scoured and bleached 18/1 filling yarns in skein form were treated with a solution containing 30 g $(NaPO_3)_6$ and 70 g water. After treatment the yarns were dried for 30 minutes at 70° C. The filling yarns were then woven with 30/1 warp yarns that were sized with starch to produce a filling oxford weighing 5 oz/yd$^2$. The fabric was cured for 10 minutes at 160° C. and then desized, scoured, and bleached. The fabric was dyed with 4% Reactive Blue 1 based on the weight of the fabric. The resulting fabric had a chambray appearance. The warp yarns were dyed blue and the phosphorylated filling yarns were undyed.

EXAMPLE 7

Samples of the fabric from Examples 1, 2, 3, 4, 5, and 6 which had been dyed with Reactive Blue 1 were dyed in a bath containing 3% Reactive Red 5 based on the weight of the fabric. The fabrics produced had a chambray appearance. The untreated yarns were dyed red and the phosphorylated filling yarns were undyed.

EXAMPLE 8

Sample of the fabric from Examples 1, 2, 3, 4, 5, and 6 which had been dyed with Reactive Blue 1 were dyed in a bath containing 2% Vat Green 1 (C.I. No. 59825) based on the weight of the fabric. The fabrics produced had a chambray appearance. The untreated yarns were dyed green and the phosphorylated filling yarns were undyed.

EXAMPLE 9

Bleached, cotton terry toweling, which weighed 14 oz/yd$^2$, was kiss roll treated on one side of fabric with a solution containing 30 g $(NaPO_3)_6$ and 70 g water. After treatment the fabric was cured for 10 minutes at 160° C. The fabric was rinsed with water and then dyed with 1% Reactive Blue 1. The resulting fabric had a forsted appearance on the side that was treated with phosphorylating agent while the reverse side or untreated side was dyed blue.

EXAMPLE 10

A sample of the fabric from Example 9 which had been dyed with Reactive Blue 1 was dyed with 5% Vat Green 1 (C.I. No. 59825). The fabric produced had a shade differential effect. The untreated side of the fabric was dyed a deep green and the pile of the fabric was dyed a light green.

EXAMPLE 11

Bleached, cotton terry toweling was treated on one side by coating with a formulation containing 15 g $(NaPO_3)_6$, 3.5 g sodium alginate thickener, and 81.5 g water. The fabric was cured for 10 minutes at 160° C. The fabric was rinsed with water and then dyed with 0.1% Reactive Blue 1 based on the weight of the fabric. The resulting fabric had a frosted appearance on the side that was treated with phosphorylating agent while the reverse side or untreated side was dyed a light blue.

EXAMPLE 12

Bleached, cotton terry toweling was treated with phosphorylating agent and cured as in Example 11. The fabric was rinsed with water and then dyed with 10% Reactive Blue 1 based on the weight of the fabric. The resulting fabric was dyed light blue on the treated side and medium blue on the untreated side.

EXAMPLE 13

Bleached, cotton terry toweling was treated with phosphorylating agent and cured as in Example 11 except that the formulation was composed of 5 g $(NaPO_3)_6$, 3.5 g sodium alginate, and 91.5 g water. The fabric was rinsed with water and then dyed with 0.5% Reactive Blue 1. The fabric was dyed light blue on the treated side and medium blue on the untreated side.

We claim:

1. A process for producing dyed fabrics with color and shade differential by piece dyeing phosphorylated fabric, said process comprising:
   (a) treating cellulose with a formulation of about 5% to 30%, by weight, of an inorganic phosphorylating agent, and about 0% to 30%, by weight, of urea;
   (b) curing the cellulose for about 2.5–10 minutes at about 160°–170° C.;
   (c) dyeing the cellulose with a cotton dye at a concentration of about 0.1% to 10% based on the weight of the fabric.

2. The process of claim 1 wherein the cellulose is in yarn form and is dried for about 15 minutes to 30 minutes at about 60° C. to 100° C. after treating with phosphorylating agent and then weaving with a starch sized warp to produce a fabric with a balanced weave.

3. The process of claim 1 wherein the cellulose is a cotton pile fabric resulting in a frosted fabric upon dyeing.

4. The process of claim 1 wherein the inorganic phosphorylating agent is dibasic ammonium phosphate [$(NH_4)_2HPO_4$].

5. The process of claim 1 wherein the inorganic phosphorylating agent is monobasic ammonium phosphate [$NH_4H_2PO_4$].

6. The process of claim 1 wherein the inorganic phosphorylating agent is dibasic potassium phosphate [$K_2HPO_4$].

7. The process of claim 1 wherein the inorganic phosphorylating agent is dibasic sodium phosphate [$Na_2HPO_4$].

8. The process of claim 1 wherein the inorganic phosphorylating agent is monobasic sodium phosphate [$NaH_2PO_4$].

9. The process of claim 1 wherein the inorganic phosphorylating agent is sodium hexametaphosphate $(NaPO_3)_6$.

10. A process for producing dyed fabrics with color and shade differential by piece dyeing phosphorylated fabric, said process comprising:
   (a) treating cellulose with a formulation of about 5% to 30%, by weight, of sodium hexametaphosphate $(NaPO_3)_6$;
   (b) curing the cellulose for about 2.5–10 minutes at about 160°–170° C.;
   (c) dyeing the cellulose with a cotton dye at a concentration of about 0.1% to 10% based on the weight of the fabric.

* * * * *